US012624509B2

(12) United States Patent
Wang et al.

(10) Patent No.: US 12,624,509 B2
(45) Date of Patent: May 12, 2026

(54) METHOD FOR REGULATING CONFLUENCE OF TRIBUTARIES WITH LARGE DROP DIFFERENCE AND LARGE ANGLE INTO TRUNK CANAL

(71) Applicant: CHONGQING JIAOTONG UNIVERSITY, Chongqing City (CN)

(72) Inventors: Yunli Wang, Chongqing City (CN); Shiliang Zhou, Chongqing City (CN); Chunhao Yan, Chongqing City (CN); Meitao Xiang, Chongqing City (CN); Xiaorong Wang, Chongqing City (CN); Xiaoyi Wang, Chongqing City (CN); Jilun Miao, Chongqing City (CN); Shengfa Yang, Chongqing City (CN); Tao Yu, Chongqing City (CN)

(73) Assignee: CHONGQING JIAOTONG UNIVERSITY, Chongqing City (CN)

( * ) Notice: Subject to any disclaimer, the term of this patent is extended or adjusted under 35 U.S.C. 154(b) by 11 days.

(21) Appl. No.: 18/659,051

(22) Filed: May 9, 2024

(65) Prior Publication Data

US 2025/0347074 A1 Nov. 13, 2025

(51) Int. Cl.
*E02B 3/02* (2006.01)
*E02B 8/06* (2006.01)

(52) U.S. Cl.
CPC ..... *E02B 8/06* (2013.01); *E02B 3/023* (2013.01)

(58) Field of Classification Search
CPC ... E02B 3/02; E02B 13/00; E02B 8/06; E02B 3/023
See application file for complete search history.

(56) References Cited

U.S. PATENT DOCUMENTS 1,494,190 A * 5/1924 Schmutte ..... E02B 3/02 405/73
1,622,568 A * 3/1927 Bignell ..... E02B 3/02 405/32
1,841,594 A * 1/1932 Dysart ..... E02B 3/02 405/32
3,167,922 A * 2/1965 Chabert ..... E02B 3/02 164/DIG. 5
3,333,420 A * 8/1967 Henson ..... E02B 3/02 405/33
3,461,674 A * 8/1969 Pye ..... E02B 1/003 405/74

(Continued)

*Primary Examiner* — Edwin J Toledo-Duran
(74) *Attorney, Agent, or Firm* — Addison D. Ault; IPGentleman Intellectual Property Services, LLC

(57) ABSTRACT

Disclosed is a method for regulating confluence of tributaries with a large drop difference and a large angle into a trunk canal. The method includes: banking up a reservoir at an upstream end of a tributary river, and widening a water surface, such that uniform distribution of water flows is completed; then conducting scouring and energy dissipation to reduce a flow velocity and kinetic energy of the water flows; then conducting flow-slowing sedimentation, such that sediment is deposited on one side of the tributary river connected to a downstream side of a trunk stream; and then conducting flow diversion at one side of the tributary river connected to an upstream side of the trunk stream, such that an included angle of confluence of tributary river water into the trunk stream is reduced.

8 Claims, 2 Drawing Sheets

(56) References Cited

U.S. PATENT DOCUMENTS 3,593,527 A * 7/1971 Mckay ..... E02B 3/02 405/107
3,667,234 A * 6/1972 De Lizasoain ..... E02B 3/02 405/80
4,028,894 A * 6/1977 Larsen ..... E02B 3/12 405/74
4,516,528 A * 5/1985 Jones ..... A01K 63/10 119/226
4,527,927 A * 7/1985 Bucherre ..... E02B 13/00 405/36
4,560,304 A * 12/1985 Jenkins ..... E02B 3/04 405/74
4,661,013 A * 4/1987 Jenkins ..... E02B 3/023 405/74
4,884,917 A * 12/1989 Christiansen ..... E02B 3/02 405/74
5,022,784 A * 6/1991 DeVries ..... E02B 3/04 405/74
5,567,079 A * 10/1996 Felder ..... E02B 3/02 405/74
5,678,955 A * 10/1997 Chappell ..... E02B 3/02 405/15
5,848,856 A * 12/1998 Bohnhoff ..... E02B 11/00 405/36
5,857,805 A * 1/1999 Chappell ..... E02B 3/02 405/15
6,394,698 B1 * 5/2002 Christiansen ..... E02B 3/02 405/74
7,066,684 B1 * 6/2006 Bourgeois ..... E02B 3/04 405/35
8,877,048 B1 * 11/2014 Owings ..... E03F 1/002 210/170.03
12,188,193 B2 * 1/2025 Akai ..... E02B 3/02
2001/0026731 A1 * 10/2001 Fukui ..... E02B 3/02 405/80
2003/0095833 A1 * 5/2003 Janz ..... E02B 8/02 405/15
2007/0189854 A1 * 8/2007 Forrest ..... E02B 3/102 405/107
2012/0315092 A1 * 12/2012 Quaglino, Jr. ..... E02B 3/02 405/80
2013/0078037 A1 * 3/2013 Chen ..... E02B 3/04 405/39
2015/0078825 A1 * 3/2015 Messina ..... E02B 3/06 405/16
2015/0110559 A1 * 4/2015 Jokela ..... E02B 9/02 405/80
2017/0298585 A1 * 10/2017 Carey ..... A01K 79/02
2019/0161954 A1 * 5/2019 Liu ..... E02B 5/02
2020/0277747 A1 * 9/2020 Mariappan ..... E02B 5/005
2021/0156101 A1 * 5/2021 Richardson ..... C02F 3/327
2023/0030676 A1 * 2/2023 Akai ..... E02B 3/023
2024/0279892 A1 * 8/2024 Reedijk ..... E02B 3/129

* cited by examiner

METHOD FOR REGULATING CONFLUENCE OF TRIBUTARIES WITH LARGE DROP DIFFERENCE AND LARGE ANGLE INTO TRUNK CANAL

TECHNICAL FIELD

The disclosure relates to the technical field of canal navigation safety maintenance, and particularly relates to a method for regulating confluence of tributaries with a large drop difference and a large angle into a trunk canal.

BACKGROUND

A canal refers to a man-made navigable river. China's Ministry of Transport has taken great efforts to increase investments in water transport infrastructure recently. Some major national strategic projects have been successively started, such as the Yangtze River diversion project to feed the Huaihe River and the backbone project of the new western land-sea passage-Pinglu Canal. A new canal has a long line, and needs to cross many small and medium-sized natural rivers through dredging and excavation. The canal has a large number of confluences of a trunk stream and tributaries (the Yangtze River diversion project to feed the Huaihe River involves 156 confluences and the Pinglu canal has 27 confluences). The trunk stream and the tributaries of the canal have complicated water conditions, which generally require special regulation.

Considering that the canal needs to be designed to have its own smooth river, the water level difference of the canal cannot be excessively large, and otherwise a large elevation difference between tributaries and a riverbed of a trunk canal will be caused. At present, a maximum elevation difference between tributaries and a trunk stream of the Pinglu canal is up to 14.7 m. In addition, since the canal is excavated manually, it generally has to be initiatively connected to tributaries during its route planning, and there are limitations of boundary lines of land for canal excavation. Therefore, a sharp-bend river is likely to be formed at a confluence of a riverbed of a trunk stream and a tributary, and the tributary can be connected to a trunk river from a concave bank side of a canal bend. In this way, confluence angles between all tributaries and a trunk canal are mostly large, the maximum one of which is 90°. Therefore, large-drop-difference confluence and sharp-bend confluence frequently occur at a confluence of a trunk canal and tributaries. In this way, a transverse flow velocity of water flows in a channel at a confluence of the canal will be large after tributary confluence. Meanwhile, due to circulation flows of a sharp-bend river, a water flow structure at a confluence of a trunk stream and tributaries is very complicated, with a chaotic flow condition. Moreover, if tributary sediment flows into the trunk canal, a channel size can be obviously reduced, which will cause a water surface of the confluence to fluctuate greatly. All kinds of factors can seriously affect navigation of ships. However, the river confluence is originally a place that is very conducive to biological reproduction and growth in river water because of its rich oxygen content and organic matter content in water. The canal's ecological environment is relatively poor through manual excavation, so it is necessary to improve construction of a river ecosystem by relying on beneficial conditions of a tributary confluence. However, excessively large flow impact, excessively chaotic flow conditions and serious sediment scouring and siltation at a confluence of a trunk stream and a tributary can greatly destroy ecological functions of the confluence of the canal and are not conducive to improvement in an ecological environment of the canal. According to experience and practice, generally in a case that a drop difference of a tributary at a confluence is larger than 5 m and meanwhile an included angle of an upstream side of the confluence between the tributary and a trunk stream is larger than 30° due to a sharp bend of the trunk stream, special regulation needs to be conducted on the tributary, so as to better ensure navigation stability and maintain ecological functions of the canal confluence.

In the Yangtze River diversion project to feed the Huaihe River currently under construction, if a tributary mouth and a trunk canal are not properly regulated, a canal channel size will be greatly influenced, development of a new large-sized canal shipping project will be seriously affected, and maintenance cost of the canal will be greatly increased. At present, the Pinglu canal, with a total length of 135 km, is in a design and construction stage. It is critical to focus on navigation, sediment blocking and comprehensive management of an ecological environment at a confluence of a trunk stream and tributaries so as to implement canal construction and give full play to canal functions. Therefore, it is necessary to propose a regulation method that integrates navigation, sediment blocking and ecological management at a confluence of a trunk stream and each tributary, so as to solve problems of navigation flow conditions, sediment deposition, and river biological growth.

SUMMARY

In order to overcome the defects in the prior art, a technical problem of the disclosure is to provide a method for regulating confluence of tributaries with a large drop difference and a large angle into a trunk canal, which can better avoid influence of a tributary river on a trunk canal, and better ensure water stability of the trunk canal, so as to improve navigation safety and ecological environment stability of a confluence. A large drop difference refers to a drop difference larger than 5 m of a tributary (within a short distance of 100 m-200 m from the confluence). A large included angle refers to an included angle larger than 30° of a confluence of a tributary connected from a concave bank end of a trunk stream (in a case that the trunk stream has a bend).

To solve the technical problem, the disclosure uses the following technical solution:

A method for regulating confluence of tributaries with a large drop difference and a large angle into a trunk canal includes banking up a water level at an upstream end of a tributary river, and widening a water surface, such that uniform distribution of water flows is completed; then conducting scouring and energy dissipation to reduce a flow velocity and kinetic energy of the water flows; then conducting flow-slowing sedimentation, such that sediment is deposited on one side of the tributary river connected to a downstream side of a trunk stream; and then conducting flow diversion at one side of the tributary river connected to an upstream side of the trunk stream, such that an included angle of confluence of tributary river water into the trunk stream is reduced.

In this way, after an upstream side of the tributary river is banked up and the water surface is widened, energy dissipation can be better conducted to dissipate kinetic energy caused by the large drop difference of the water flows of the tributary. Then, sediment settlement is completed through flow-slowing of the water flows. Finally, tributary river water converging into the trunk stream is divided, such that the included angle of confluence of the tributary river water into the trunk stream is reduced. In this way, not only a flow velocity of the confluence of the tributaries is effectively reduced, but also impact and influence of the tributaries on a trunk channel are reduced, and sediment settlement may be well guided, such that stability of an ecological environment at the confluence is effectively maintained.

Further, through banking-up of a water level at an upper end of the tributary river, bed load sediment in the tributary river is settled before the water surface is widened. Then, suspended load sediment in the tributary river is settled after scouring and energy dissipation are conducted on the water flows.

In this way, the sediment in the tributary river is divided into bed-load and suspended-load. Through banking-up of the water level at the upstream end of the tributary, some bed load sediment may be better removed, and then only the suspended load sediment needs to be settled at the confluence of the tributary. On one hand, sediment settlement difficulty at the confluence is greatly reduced, which is more conducive to restoration and maintenance of the ecological environment at the confluence. On the other hand, influence of impact of a large amount of sediment on an energy dissipation structure of a river is eliminated, and stability of the energy dissipation structure of the river is ensured.

Further, the method is implemented by means of a hydraulic construction system for energy dissipation, sediment settling and flow diversion of a tributary river. The hydraulic construction system for energy dissipation, sediment settling and flow diversion of a tributary river is arranged in the tributary river and includes a high platform, a stilling basin, a low platform and a diversion dike that are sequentially connected from the upstream end to a downstream section of the tributary river. An upstream end of the high platform is provided with a sediment-blocking downflow weir. Riverbanks on two sides of the high platform are designed to be splayed and widened in a downstream direction. A downstream end of the high platform is connected to a steep slope of the stilling basin. A lower end of the steep slope is connected to a basin body of the stilling basin. A downstream end of the basin body of the stilling basin is connected to the low platform. An upstream end of the low platform is higher than a bottom of the basin body of the stilling basin such that the basin body is formed. The diversion dike has a consistent water flow direction with the trunk stream of a confluence and is fixedly arranged at a joint of an upstream side of a tributary and the trunk stream such that the diversion dike and the upstream side of the tributary river intersect at an obtuse angle. A lower half of the low platform is located between the diversion dike and an opposite tributary downstream side bank.

In this way, by means of the stilling basin, the hydraulic construction system for energy dissipation, sediment settling and flow diversion of a tributary river completes energy dissipation of the water flows in the tributary river so as to decrease the flow velocity of the water flows, such that kinetic energy caused by the large drop difference is eliminated, and the water flows in the tributary may converge into the trunk stream under a stable flow condition. In this way, subsequent sediment deposition is facilitated, impact on the trunk channel is eliminated, and restoration of the ecological environment at the confluence is facilitated. The water level is banked up with one high platform at an upstream end of the stilling basin. The high platform and the sediment-blocking downflow weir at the upstream end together constitute a tributary water-level banking-up and sediment-blocking structure. After the water level is banked up, an energy dissipation effect of the stilling basin can be improved, and a surface slope and a flow velocity of the river at the upstream end of the tributary can be reduced. In this way, scouring of a riverbed at an upstream side of the tributary can be reduced, and a source of sediment at the upstream end can be actively reduced. After the water flows in the tributary reach a position of the high platform, the water flows are blocked by the sediment-blocking downflow weir while the flow velocity decreases. The bed load sediment at a lower part of the water flows is blocked, while the water flows (containing the suspended load sediment) with a less sediment content at an upper part of the water flows may continue to flow down over the sediment-blocking downflow weir. In this way, some bed load sediment initially settled in the water flows can be blocked and deposited at the upstream end of the tributary. In this way, the sediment is settled in a graded manner, such that the burden of subsequent sediment treatment can be greatly reduced, scouring damages of a stilling basin structure caused by a large amount of bed load sediment in the water flows can be avoided, and the service life of the stilling basin can be greatly improved. The water flows cross the sediment-blocking downflow weir and then reach the high platform. A splayed and widened structure on the two sides of the high platform is formed by outward expansion on the basis of a width of an original riverbank of the tributary, and an expansion range of the riverbank is connected downward until the confluence. In this way, a high platform structure forms a sufficient diffusion cross section while banking up the water level, and diversion and regulation of tributary water are completed, such that the water flows can enter the steep slope of the stilling basin uniformly and stably so as to better achieve energy dissipation, stability of the stilling basin can be ensured, and the service life of the stilling basin can be prolonged. Meanwhile, after the riverbank of the tributary is widened, slowing-down of the flow velocity of the water flows at the confluence is facilitated, which is conducive to restoration and cultivation of the ecological environment of water at the confluence. The tributary water enters the low platform after undergoing energy dissipation with the stilling basin. The low platform is a flat-bottomed transition section from the downstream side of the stilling basin to a head of the diversion dike. After the water flows are adjusted through the section, turbulence of the water flows is further reduced, the flow velocity is further reduced, and the sediment is further deposited, such that settlement of the suspended load sediment is completed. The diversion dike adjusts a flow direction of the water flows converging from the tributary to be basically consistent with that in the canal, which avoids scouring influence of the tributary on the trunk channel. Meanwhile, after the water flows in the low platform are slowed down, the confluence of the trunk stream and the tributary can stably form an ecological environment conducive to reproduction of water organisms. The diversion dike is arranged to intersect the upstream side of the tributary river at an obtuse angle so as to achieve flow diversion, such that influence of the tributary on the trunk channel can be avoided, one side near the diversion dike in the low platform can be impacted by the water flows to a certain extent, and a counter-acting force of the diversion dike can better drive the sediment to implement stable secondary deposition at the downstream side of the tributary river, which is conducive to regular dredging. Therefore, after passing the hydraulic construction system, the water flows in the tributary can converge into the canal at a small angle, a small flow velocity, a small water surface fluctuation, a small slope, and a small sediment concentration, such that navigation and sediment-blocking regulation at the confluence of the trunk stream and the tributary.

Further, a trunk river has a widening zone formed through external widening on upstream and downstream sides of the confluence of the tributary, the tributary is connected to the widening zone, and the diversion dike is arranged in the widening zone.

In this way, a turn radius of a bend of the trunk river can be enlarged, and impact of the tributary on the trunk channel can be better alleviated.

Further, a design length of the high platform is designed to satisfy a requirement of full diffusion of the water flows in the section under a maximum design flow.

In this way, the high platform can better complete diversion and regulation of the tributary water, and avoid damages caused by cavitation and damage on the steep slope due to an insufficient flow regulation effect. During implementation, a downstream outlet width of the high platform satisfies a maximum design unit discharge, which is preferably designed at 5000 L/sm, such that an effect can be better ensured.

Further, the steep slope of the stilling basin has a slope of 1:4.

In this way, a desirable effect of scouring and energy dissipation can be ensured, and meanwhile, the water flows can better flow from a top of the steep slope to downstream in an attached manner. Cavitation and damage on a slope surface are avoided, otherwise the steep slope is easily damaged.

Further, the basin body of the stilling basin has a length of 30 m-50 m and a depth is 1 m-2 m.

In this way, high-velocity water flows flowing through an upstream steep slope of 1:4 can fully dissipate energy in a short tributary length. The flow velocity of the water flows after passing the stilling basin is greatly reduced, such that secondary deposition of some bed load sediment not blocked by the upstream sediment-blocking downflow weir and suspended load sediment is better implemented.

Further, a widened joint section is excavated on a bank of the trunk canal at a joint below a confluence of the trunk stream and the tributary in an expanded manner.

During implementation, the widened joint section can further control and reduce a unit discharge of the tributary at the confluence, and better control the designed unit discharge of confluence of the tributary from the head of the diversion dike at 8000 L/sm. In this way, a water flow-slowing zone having a certain length and width is formed on one side of the canal channel at the confluence of the trunk stream and the tributary, a water flow structure of the tributary converging from the head of the diversion dike can be further adjusted, and finally the water flows can enter into the trunk canal under a more stable flow condition, such that a maximum amplitude in the trunk channel can be less than 0.3 m, which satisfies navigation safety of ships. Meanwhile, the confluence of the tributary does not cause a large surface slope, such that influence of sudden confluence of the tributary on ship navigation in the trunk canal can be reduced. Moreover, in a water flow-slowing zone of a widened section of the confluence of the tributary of the canal, anchorage conditions can be provided for temporary berthing of ships.

Further, a bank of one side, corresponding to the diversion dike, of the low platform is provided with a concave arc-shaped downstream settlement zone.

In this way, the diversion dike is arranged to intersect the upstream side of the tributary river at an obtuse angle, the water flows entering the low platform may impact the diversion dike and push the sediment deposited to a bank of an opposite side of the diversion dike through a counteracting force, and the concave settlement zone is less impacted by the water flows, such that the sediment can be concentrated and settled in the settlement zone, which is conducive to dredging, influence of silt accumulation on a middle zone of the low platform can be reduced, and stability of an underwater ecological environment in the zone can be better maintained. During implementation, a bottom of the downstream settlement zone is lower than a bottom of the low platform, which can better facilitate sediment settlement and facilitate sediment excavation.

Further, the sediment-blocking downflow weir includes a middle weir arranged along a cross section of the tributary river, and further includes an upper weir arranged on an upstream side of the middle weir in a spaced manner. Cross sections of the upper weir and the middle weir are both convex arc-shaped.

In this way, upstream flowing water of the tributary river passes two submerged downflow weirs, such that the bed load sediment can be better blocked. The upper weir is arranged to improve a sediment blocking effect, and better guide the sediment, which is conducive to subsequent regulation of the sediment. Meanwhile, the submerged weir is a convex arc-shaped structure, which is more stable and is not likely to cause dam failure through scouring with upstream water pressure and the water flows.

Further, the upper weir is obliquely arranged in an upstream direction of the tributary at one end of a bank where the diversion dike of the tributary is located.

In this way, the bed load sediment blocked by the submerged weir can move and accumulate in an inclined direction of the upper weir towards a bank on the upstream side of the tributary facing away from a flow guide, which is conducive to dredging. During implementation, the upper weir may be inclined by 5°-15°. In this way, a better sediment guiding effect can be achieved without causing large fluctuation of a subsequent water level. In addition, a height of the middle weir is slightly larger than that of the upper weir by 1 cm-10 cm during implementation, which ensures that a sediment guiding effect of the upper weir cannot influence blocking of the bed load sediment.

Further, an upstream side of the upper weir is provided with a concave arc-shaped upstream settlement zone on a bank of the tributary facing away from the diversion dike.

In this way, the bed load sediment blocked by the submerged weir can be guided into the upstream settlement zone, such that deposition and dredging can be better implemented.

Further, a bottom of the upstream settlement zone is provided with a sediment discharge pipe, a lower end of the sediment discharge pipe is obliquely downward connected to a bank of the downstream settlement zone so as to form a sediment discharge port, an upper end port of the sediment discharge pipe is provided with a sediment discharge valve, and a stirring device is mounted outside the sediment discharge valve.

In this way, when dredging is needed, only the sediment discharge valve and the stirring device need to be opened, such that the sediment can be directly discharged from the sediment discharge pipe to the sediment discharge port at the lower end through the combined action of stirring and water pressure, and convenience of dredging can be greatly improved.

Further, the sediment-blocking downflow weir further includes a lower weir arranged on a downstream side of the middle weir in a spaced manner, and a cross section of the lower weir is convex arc-shaped.

In this way, the upstream end of the tributary can better block the bed load sediment through three submerged weirs. During implementation, a height of the lower weir may be consistent with that of the upper weir.

Further, the lower weir is obliquely arranged in a downstream direction of the tributary at one end of a bank where the diversion dike of the tributary is located.

In this way, the lower weir and the upper weir have the opposite inclined directions, and reverse diversion is implemented, such that guiding influence of the upper weir obliquely arranged on the water flows crossing the submerged weir can be well counteracted, water flow balance can be restored, and influence of large water flow interference on the sediment settlement effect in the downstream settlement zone can be avoided. During implementation, an inclination angle of the lower weir may be the same as or slightly larger than that of the upper weir, such that the above diversion effect can be ensured.

Further, a surface of the high platform is further provided with half rows of energy dissipation piles arranged obliquely at intervals. The energy dissipation piles extend obliquely to a middle position of the high platform from a bank of one side of the upstream end of the high platform facing away from a direction of the diversion dike. The energy dissipation piles are cylindrical piles and have diameters gradually reduced from top to bottom.

The energy dissipation piles having a special structure are arranged to effectively eliminate part of kinetic energy of the water flows at one side facing away from the diversion dike without influencing fluctuation of the water flows to the greatest extent, such that the water flows at one side of the low platform facing away from the diversion dike gradually become more stable, the settled sediment can be pushed to the downstream settlement zone at the side with a counteracting force of the diversion dike so as to implement settlement, and the situation that a large amount of sediment is settled in the middle of a lower platform so as to influence a water ecological environment in the zone can be avoided. Meanwhile, the energy dissipation piles are mounted on the high platform, such that sediment deposition can be avoided in front of the energy dissipation piles.

Therefore, the above solution has the following five benefits: first, the confluence angle of the water flows at the confluence of the tributary is adjusted, such that the transverse velocity of the trunk stream at the confluence relative to a center line of the canal channel satisfies a navigation limit requirement of the transverse velocity specified in the specification; second, strong kinetic energy of the water flows caused by the large drop difference after topographic excavation of the trunk stream and the tributary can be effectively eliminated, such that the tributary water flows into the trunk stream under a stable flow condition, and water level fluctuation in the canal satisfies a navigation parameter requirement of a wave height limit specified in the specification; third, most of the sediment carried in the tributary water is blocked in the confluence of the tributary, which is conducive to canal channel maintenance, such that the service life of the canal can be prolonged, a lot of canal maintenance cost can be saved, and meanwhile, large-scale riverbed scouring in the tributary before and after the project cannot be caused; fourth, the water flows at the confluence of the trunk stream and the tributary of the constructed canal flow gently, a river width is rich, and meanwhile, a function of ship anchorage is achieved, such that cost for canal construction is saved; and fifth, a low-velocity zone from the stilling basin in a lower section of the confluence of the tributary to the head of the diversion dike may be used as an ecological habitat to provide a growth space for living things in the river.

In conclusion, the disclosure can better avoid influence of the tributary river on the trunk canal, and better ensure water stability of the trunk canal, so as to improve navigation safety and ecological environment stability of the confluence.

Figure 1:
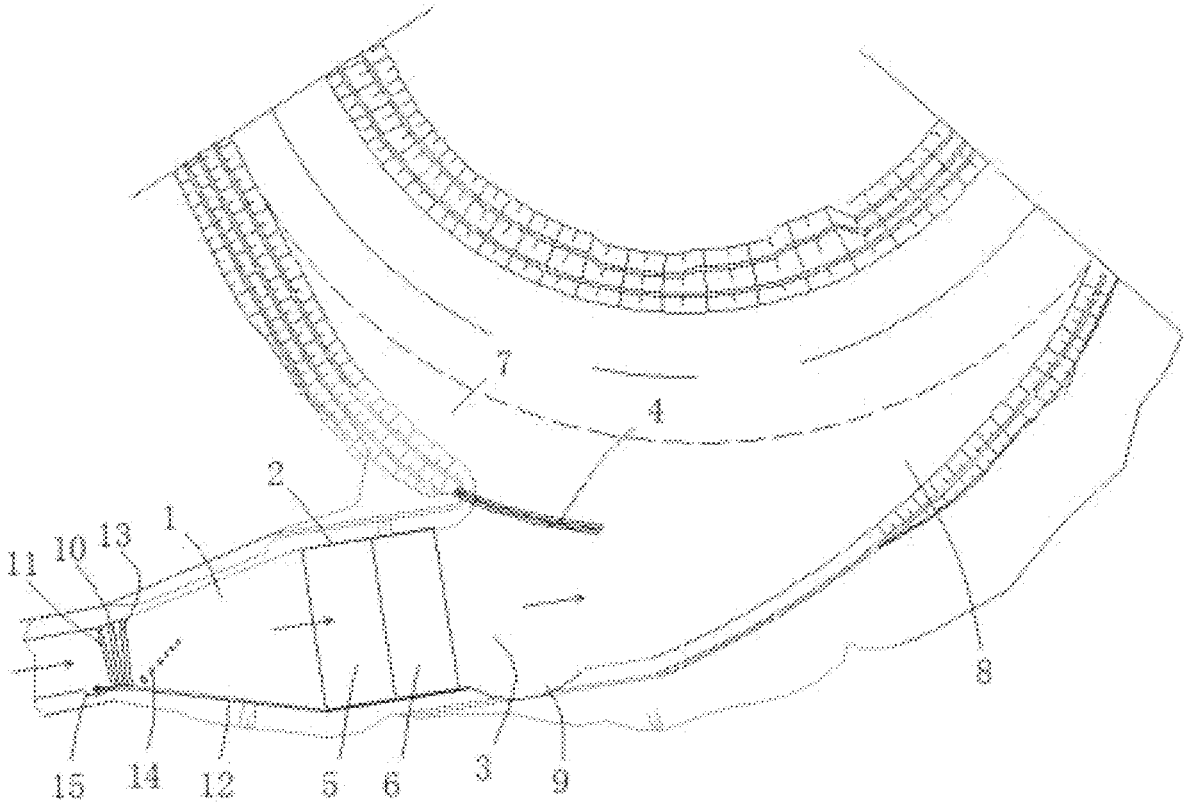
FIG. 1 is a schematic diagram of a hydraulic construction system for energy dissipation, sediment settling and flow diversion of a tributary river in the disclosure during specific implementation. An arrow in the figure indicates a water flow direction of a tributary.

The disclosure will be further described in detail below in conjunction with specific embodiments.

DETAILED DESCRIPTIONS OF THE EMBODIMENTS

A method for regulating confluence of tributaries with a large drop difference and a large angle into a trunk canal includes the following steps: a water level at an upstream end of a tributary river is banked up, and a water surface is widened, such that uniform distribution of water flows is completed; then scouring and energy dissipation are conducted to reduce a flow velocity and kinetic energy of the water flows; then flow-slowing sedimentation is conducted, such that sediment is deposited on one side of the tributary river connected to a downstream side of a trunk stream; and then flow diversion is conducted at one side of the tributary river connected to an upstream side of the trunk stream, such that an included angle of confluence of tributary river water into the trunk stream is reduced.

In this way, after an upstream side of the tributary river is banked up and the water surface is widened, energy dissipation can be better conducted to dissipate kinetic energy caused by the large drop difference of the water flows of the tributary. Then, sediment settlement is completed through flow-slowing of the water flows. Finally, tributary river water converging into the trunk stream is divided, such that the included angle of confluence of the tributary river water into the trunk stream is reduced. In this way, not only a flow velocity of the confluence of the tributaries is effectively reduced, but also impact and influence of the tributaries on a trunk channel are reduced, and sediment settlement may be well guided, such that stability of an ecological environment at the confluence is effectively maintained.

Through banking-up of a water level at an upper end of the tributary river, bed load sediment in the tributary river is settled before the water surface is widened. Then, suspended load sediment in the tributary river is settled after scouring and energy dissipation are conducted on the water flows.

In this way, the sediment in the tributary river is divided into bed-load and suspended-load. Through banking-up of the water level at the upstream end of the tributary, some bed load sediment may be better removed, and then only the suspended load sediment needs to be settled at the confluence of the tributary. On one hand, sediment settlement difficulty at the confluence is greatly reduced, which is more conducive to restoration and maintenance of the ecological environment at the confluence. On the other hand, influence of impact of a large amount of sediment on an energy dissipation structure of a river is eliminated, and stability of the energy dissipation structure of the river is ensured. In addition, during implementation, before a hydraulic structure in the tributary river is constructed, upstream and downstream sides of the trunk river at the confluence of the tributary can be further excavated and widened. Meanwhile, a turn radius of a bend of the trunk river is enlarged, and impact of the tributary on the trunk channel can be better alleviated.

Figure 2:
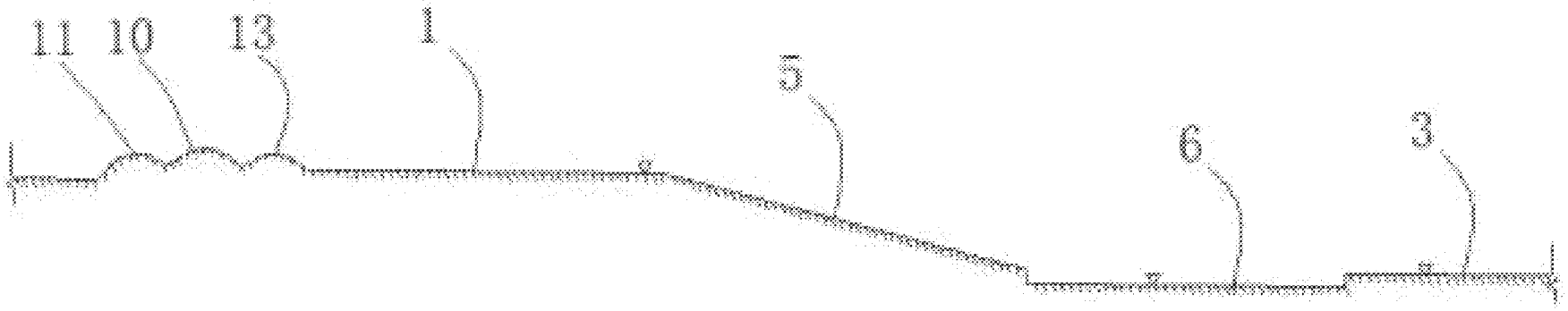
FIG. 2 is a schematic diagram of a longitudinal section of a bottom of a riverbed of a single tributary in FIG. 1.

The method is implemented by means of a hydraulic construction system for energy dissipation, sediment settling and flow diversion of a tributary river. With reference to FIGS. 1 and 2, the hydraulic construction system for energy dissipation, sediment settling and flow diversion of a tributary river is arranged in the tributary river and includes a high platform 1, a stilling basin 2, a low platform 3 and a diversion dike 4 that are sequentially connected from the upstream end to a downstream section of the tributary river. An upstream end of the high platform 1 is provided with a sediment-blocking downflow weir. Riverbanks on two sides of the high platform 1 are designed to be splayed and widened in a downstream direction. A downstream end of the high platform 1 is connected to a steep slope 5 of the stilling basin. A lower end of the steep slope 5 is connected to a basin body 6 of the stilling basin. A downstream end of the basin body of the stilling basin is connected to the low platform 3. An upstream end of the low platform 3 is higher than a bottom of the basin body of the stilling basin such that the basin body is formed. The diversion dike 4 has a consistent water flow direction with the trunk stream of a confluence and is fixedly arranged at a joint of an upstream side of a tributary and the trunk stream such that the diversion dike 4 and the upstream side of the tributary river intersect at an obtuse angle. A lower half of the low platform 3 is located between the diversion dike 4 and an opposite tributary downstream side bank.

In this way, by means of the stilling basin, the hydraulic construction system for energy dissipation, sediment settling and flow diversion of a tributary river completes energy dissipation of the water flows in the tributary river so as to decrease the flow velocity of the water flows, such that kinetic energy caused by the large drop difference is eliminated, and the water flows in the tributary may converge into the trunk stream under a stable flow condition. In this way, subsequent sediment deposition is facilitated, impact on the trunk channel is eliminated, and restoration of the ecological environment at the confluence is facilitated. The water level is banked up with one high platform at an upstream end of the stilling basin. The high platform and the sediment-blocking downflow weir at the upstream end together constitute a tributary water-level banking-up and sediment-blocking structure. After the water level is banked up, an energy dissipation effect of the stilling basin can be improved, and a surface slope and a flow velocity of the river at the upstream end of the tributary can be reduced. In this way, scouring of a riverbed at an upstream side of the tributary can be reduced, and a source of sediment at the upstream end can be actively reduced. After the water flows in the tributary reach a position of the high platform, the water flows are blocked by the sediment-blocking downflow weir while the flow velocity decreases. The bed load sediment at a lower part of the water flows is blocked, while the water flows (containing the suspended load sediment) with a less sediment content at an upper part of the water flows may continue to flow down over the sediment-blocking downflow weir. In this way, some bed load sediment initially settled in the water flows can be blocked and deposited at the upstream end of the tributary. In this way, the sediment is settled in a graded manner, such that the burden of subsequent sediment treatment can be greatly reduced, scouring damages of a stilling basin structure caused by a large amount of bed load sediment in the water flows can be avoided, and the service life of the stilling basin can be greatly improved. The water flows cross the sediment-blocking downflow weir and then reach the high platform. A splayed and widened structure on the two sides of the high platform is formed by outward expansion on the basis of a width of an original riverbank of the tributary, and an expansion range of the riverbank is connected downward until the confluence. In this way, a high platform structure forms a sufficient diffusion cross section while banking up the water level, and diversion and regulation of tributary water are completed, such that the water flows can enter the steep slope of the stilling basin uniformly and stably so as to better achieve energy dissipation, stability of the stilling basin can be ensured, and the service life of the stilling basin can be prolonged. Meanwhile, after the riverbank of the tributary is widened, slowing-down of the flow velocity of the water flows at the confluence is facilitated, which is conducive to restoration and cultivation of the ecological environment of water at the confluence. The tributary water enters the low platform after undergoing energy dissipation with the stilling basin. The low platform is a flat-bottomed transition section from the downstream side of the stilling basin to a head of the diversion dike. After the water flows are adjusted through the section, turbulence of the water flows is further reduced, the flow velocity is further reduced, and the sediment is further deposited, such that settlement of the suspended load sediment is completed. The diversion dike adjusts a flow direction of the water flows converging from the tributary to be basically consistent with that in the canal, which avoids scouring influence of the tributary on the trunk channel. Meanwhile, after the water flows in the low platform are slowed down, the confluence of the trunk stream and the tributary can stably form an ecological environment conducive to reproduction of water organisms. The diversion dike is arranged to intersect the upstream side of the tributary river at an obtuse angle so as to achieve flow diversion, such that influence of the tributary on the trunk channel can be avoided, one side near the diversion dike in the low platform can be impacted by the water flows to a certain extent, and a counter-acting force of the diversion dike can better drive the sediment to implement stable secondary deposition at the downstream side of the tributary river, which is conducive to regular dredging. Therefore, after passing the hydraulic construction system, the water flows in the tributary can converge into the canal at a small angle, a small flow velocity, a small water surface fluctuation, a small slope, and a small sediment concentration, such that navigation and sediment-blocking regulation at the confluence of the trunk stream and the tributary. During specific implementation, the hydraulic construction system for energy dissipation, sediment settling and flow diversion of a tributary river is especially suitable for a river with a sharp bend in a trunk stream, and is also suitable for a case that a trunk stream at a confluence is a straight river.

A trunk river has a widening zone 7 formed through external widening on upstream and downstream sides of the confluence of the tributary, the tributary is connected to the widening zone 7, and the diversion dike 4 is arranged in the widening zone 7.

In this way, a turn radius of a bend of the trunk river can be enlarged, and impact of the tributary on the trunk channel can be better alleviated.

A design length of the high platform 1 is designed to satisfy a requirement of full diffusion of the water flows in the section under a maximum design flow.

In this way, the high platform can better complete diversion and regulation of the tributary water, and avoid damages caused by cavitation and damage on the steep slope due to an insufficient flow regulation effect. During implementation, a downstream outlet width of the high platform satisfies a maximum design unit discharge, which is preferably designed at 5000 L/sm, such that an effect can be better ensured.

The steep slope 5 of the stilling basin has a slope of 1:4.

In this way, a desirable effect of scouring and energy dissipation can be ensured, and meanwhile, the water flows can better flow from a top of the steep slope to downstream in an attached manner. Cavitation and damage on a slope surface are avoided, otherwise the steep slope is easily damaged.

The basin body 6 of the stilling basin has a length of 30 m-50 m and a depth is 1 m-2 m.

In this way, high-velocity water flows flowing through an upstream steep slope of 1:4 can fully dissipate energy in a short tributary length. The flow velocity of the water flows after passing the stilling basin is greatly reduced, such that secondary deposition of some bed load sediment not blocked by the upstream sediment-blocking downflow weir and suspended load sediment is better implemented.

A widened joint section 8 is excavated on a bank of the trunk canal at a joint below a confluence of the trunk stream and the tributary in an expanded manner.

During implementation, the widened joint section can further control and reduce a unit discharge of the tributary at the confluence, and better control the designed unit discharge of confluence of the tributary from the head of the diversion dike at 8000 L/sm. In this way, a water-slowing zone having a certain length and width is formed on one side of the canal channel at the confluence of the trunk stream and the tributary, a water flow structure of the tributary converging from the head of the diversion dike can be further adjusted, and finally the water flows can flow into the trunk canal under a more stable flow condition, such that a maximum amplitude in the trunk channel can be less than 0.3 m, which satisfies navigation safety of ships. Meanwhile, the confluence of the tributary does not cause a large surface slope, such that influence of sudden confluence of the tributary on ship navigation in the trunk canal can be reduced. Moreover, in a flow-slowing zone of a widened section of the confluence of the tributary of the canal, anchorage conditions can be provided for temporary berthing of ships.

A bank of one side, corresponding to the diversion dike 4, of the low platform 3 is provided with a concave arc-shaped downstream settlement zone 9.

In this way, the diversion dike is arranged to intersect the upstream side of the tributary river at an obtuse angle, the water flows entering the low platform may impact the diversion dike and push the sediment deposited to a bank of an opposite side of the diversion dike through a counteracting force, and the concave settlement zone is less impacted by the water flows, such that the sediment can be concentrated and settled in the settlement zone, which is conducive to dredging, influence of silt accumulation on a middle zone of the low platform can be reduced, and stability of an underwater ecological environment in the zone can be better maintained. During implementation, a bottom of the downstream settlement zone is lower than a bottom of the low platform, which can better facilitate sediment settlement and facilitate sediment excavation.

The sediment-blocking downflow weir includes a middle weir 10 arranged along a cross section of the tributary river, and further includes an upper weir 11 arranged on an upstream side of the middle weir in a spaced manner. Cross sections of the upper weir 11 and the middle weir 10 are both convex arc-shaped.

In this way, upstream flowing water of the tributary river passes two submerged downflow weirs, such that the bed load sediment can be better blocked. The upper weir is arranged to improve a sediment blocking effect, and better guide the sediment, which is conducive to subsequent regulation of the sediment. Meanwhile, the submerged weir is a convex arc-shaped structure, which is more stable and is not likely to cause dam failure through scouring with upstream water pressure and the water flows.

The upper weir 11 is obliquely arranged in an upstream direction of the tributary at one end of a bank where the diversion dike of the tributary is located.

In this way, the bed load sediment blocked by the submerged weir can move and accumulate in an inclined direction of the upper weir towards a bank on the upstream side of the tributary facing away from a flow guide, which is conducive to dredging. During implementation, the upper weir may be inclined by 5°-15°. In this way, a better sediment guiding effect can be achieved without causing large fluctuation of a subsequent water level. In addition, during implementation, a height of the sediment-blocking downflow weir is designed to be flush with an upstream water level of a submerged dam under a condition of once-in-two-year flood. Specifically, the height of the middle weir may be about 2 m, which ensures a better sediment blocking and deposition effect. The height of the middle weir is slightly larger than that of the upper weir by 1 cm-10 cm, which ensures that a sediment guiding effect of the upper weir cannot influence blocking of the bed load sediment.

An upstream side of the upper weir 11 is provided with a concave arc-shaped upstream settlement zone 15 on a bank of the tributary facing away from the diversion dike.

In this way, the bed load sediment blocked by the submerged weir can be guided into the upstream settlement zone, such that deposition and dredging can be better implemented.

A bottom of the upstream settlement zone 15 is provided with a sediment discharge pipe 12. A lower end of the sediment discharge pipe 12 is obliquely downward connected to a bank of the downstream settlement zone 9 so as to form a sediment discharge port. An upper end port of the sediment discharge pipe is provided with a sediment discharge valve. A stirring device is mounted outside the sediment discharge valve.

In this way, when dredging is needed, only the sediment discharge valve and the stirring device need to be opened, such that the sediment can be directly discharged from the sediment discharge pipe to the sediment discharge port at the lower end through the combined action of stirring and water pressure, and convenience of dredging can be greatly improved.

The sediment-blocking downflow weir further includes a lower weir 13 arranged on a downstream side of the middle weir in a spaced manner. A cross section of the lower weir 13 is convex arc-shaped.

In this way, the upstream end of the tributary can better block the bed load sediment through three submerged weirs. During implementation, a height of the lower weir may be consistent with that of the upper weir.

The lower weir 13 is obliquely arranged in a downstream direction of the tributary at one end of a bank where the diversion dike 4 of the tributary is located.

In this way, the lower weir and the upper weir have the opposite inclined directions, and reverse diversion is implemented, such that guiding influence of the upper weir obliquely arranged on the water flows crossing the submerged weir can be well counteracted, water flow balance can be restored, and influence of large water flow interference on the sediment settlement effect in the downstream settlement zone can be avoided. During implementation, an inclination angle of the lower weir may be the same as or slightly larger than that of the upper weir, such that the above diversion effect can be ensured.

A surface of the high platform is further provided with half rows of energy dissipation piles 14 arranged obliquely at intervals. The energy dissipation piles 14 extend obliquely to a middle position of the high platform from a bank of one side of the upstream end of the high platform facing away from a direction of the diversion dike. The energy dissipation piles are cylindrical piles and have diameters gradually reduced from top to bottom.

The energy dissipation piles having a special structure are arranged to effectively eliminate part of kinetic energy of the water flows at one side facing away from the diversion dike without influencing fluctuation of the water flows to the greatest extent, such that the water flows at one side of the low platform facing away from the diversion dike gradually become more stable, the settled sediment can be pushed to the downstream settlement zone at the side with a counteracting force of the diversion dike so as to implement settlement, and the situation that a large amount of sediment is settled in the middle of a lower platform so as to influence a water ecological environment in the zone can be avoided. Meanwhile, the energy dissipation piles are mounted on the high platform, such that sediment deposition can be avoided in front of the energy dissipation piles.

Therefore, the above solution has the following five benefits: first, the confluence angle of the water flows at the confluence of the tributary is adjusted, such that the transverse velocity of the trunk stream at the confluence relative to a center line of the canal channel satisfies a navigation limit requirement of the transverse velocity specified in the specification; second, strong kinetic energy of the water flows caused by the large drop difference after topographic excavation of the trunk stream and the tributary can be effectively eliminated, such that the tributary water flows into the trunk stream under a stable flow condition, and water level fluctuation in the canal satisfies a navigation parameter requirement of a wave height limit specified in the specification; third, most of the sediment carried in the tributary water is blocked in the confluence of the tributary, which is conducive to canal channel maintenance, such that the service life of the canal can be prolonged, a lot of canal maintenance cost can be saved, and meanwhile, large-scale riverbed scouring in the tributary before and after the project cannot be caused; fourth, the water flows at the confluence of the trunk stream and the tributary of the constructed canal flow gently, a river width is rich, and meanwhile, a function of ship anchorage is achieved, such that cost for canal construction is saved; and fifth, a low-velocity zone from the stilling basin in a lower section of the confluence of the tributary to the head of the diversion dike may be used as an ecological habitat to provide a growth space for living things in the river.

What it claimed is:

1. A method for regulating confluence of tributaries with a large drop difference and a large angle into a trunk canal, comprising: banking up a water level at an upstream end of a tributary river, and widening a water surface, such that uniform distribution of water flows is completed; then conducting souring and energy dissipation to reduce a flow velocity and kinetic energy of the water flows; then conducting flow-slowing sedimentation, such that sediment is deposited on one side of the tributary river connected to a downstream side of a trunk stream; and then conducting flow diversion at one side of the tributary river connected to an upstream side of the trunk stream, such that an included angle of confluence of tributary river water into the trunk stream is reduced;

wherein the method is implemented by means of a hydraulic construction system for energy dissipation, sediment settling and flow diversion of a tributary river, wherein the hydraulic construction system for energy dissipation, sediment settling and flow diversion of a tributary river is arranged in the tributary river and comprises a high platform, a stilling basin, a low platform and a diversion dike that are sequentially connected from the upstream end to a upstream section of the tributary river, wherein an upstream end of the high platform is provided with a sediment-blocking downflow weir, riverbanks on two sides of the high platform are designed to be splayed and widened in a downstream direction, a downstream end of the high platform is connected to a steep slope of the stilling basin, a lower end of the steep slope is connected to a basin body of the stilling basin, a downstream end of the basin body of the stilling basin is connected to the low platform, an upstream end of the low platform is higher than a bottom of the basin body of the stilling basin such that the basin body is formed, the diversion dike has a consistent water flow direction with the trunk stream of a confluence and is fixedly arranged at a joint of an upstream side of a tributary and the trunk stream such that the diversion dike and the upstream side of the tributary river intersect at an obtuse angle, and a lower half of the low platform is located between the diversion dike and an opposite tributary downstream side bank;

and wherein a trunk river has a widening zone formed through external widening on upstream and downstream sides of the confluence of the tributary, the tributary is connected to the widening zone, and the diversion dike is arranged in the widening zone.

2. The method for regulating confluence of tributaries with a large drop difference and a large angle into a trunk canal according to claim 1, wherein through banking-up of a reservoir at an upper end of the tributary river, bed load sediment in the tributary river is settled before the water surface is widened; and then, suspended load sediment in the tributary river is settled after scouring and energy dissipation are conducted on the water flows.

3. The method for regulating confluence of tributaries with a large drop difference and a large angle into a trunk canal according to claim 1, wherein the steep slope of the stilling basin has a slope of 1:4; and the basin body of the stilling basin has a length of 30 m-50 m and a depth is 1 m-2 m.

4. The method for regulating confluence of tributaries with a large drop difference and a large angle into a trunk canal according to claim 1, wherein a widened joint section is excavated on a bank of the trunk canal at a joint below a confluence of the trunk stream and the tributary in an expanded manner.

5. The method for regulating confluence of tributaries with a large drop difference and a large angle into a trunk canal according to claim 1, wherein a bank of one side, corresponding to the diversion dike, of the low platform is provided with a concave arc-shaped downstream settlement zone.

6. The method for regulating confluence of tributaries with a large drop difference and a large angle into a trunk canal according to claim 1, wherein the sediment-blocking downflow weir comprises a middle weir arranged along a cross section of the tributary river, and further comprises an upper weir arranged on an upstream side of the middle weir in a spaced manner, and cross sections of the upper weir and the middle weir are both convex arc-shaped.

7. The method for regulating confluence of tributaries with a large drop difference and a large angle into a trunk canal according to claim 6, wherein the upper weir is obliquely arranged in an upstream direction of the tributary at one end of a bank where the diversion dike of the tributary is located.

8. The method for regulating confluence of tributaries with a large drop difference and a large angle into a trunk canal according to claim 7, wherein an upstream side of the upper weir is provided with a concave arc-shaped upstream settlement zone on a bank of the tributary facing away from the diversion dike; a bottom of the concave arc-shaped upstream settlement zone is provided with a sediment discharge pipe, a lower end of the sediment discharge pipe is obliquely downward connected to a bank of the concave arc-shaped downstream settlement zone so as to form a sediment discharge port, an upper end port of the sediment discharge pipe is provided with a sediment discharge valve, and a stirring device is mounted outside the sediment discharge valve; and the sediment-blocking downflow weir further comprises a lower weir arranged on a downstream side of the middle weir in a spaced manner, and a cross section of the lower weir is convex arc-shaped.

* * * * *